US006371733B1

(12) United States Patent
Renfro

(10) Patent No.: US 6,371,733 B1
(45) Date of Patent: Apr. 16, 2002

(54) PUMP WITH HYDRAULIC LOAD SENSOR AND CONTROLLER

(75) Inventor: Wesley E. Renfro, Burton, OH (US)

(73) Assignee: Accuspray, Inc., Cleveland, OH (US)

( * ) Notice: Subject to any disclaimer, the term of this patent is extended or adjusted under 35 U.S.C. 154(b) by 0 days.

(21) Appl. No.: 09/576,164

(22) Filed: May 22, 2000

Related U.S. Application Data

(60) Continuation-in-part of application No. 09/413,120, filed on Oct. 6, 1999, now abandoned, which is a division of application No. 09/005,702, filed on Jan. 12, 1998, now Pat. No. 5,984,646.

(60) Provisional application No. 60/043,774, filed on Apr. 11, 1997.

(51) Int. Cl.[7] ..... F04B 1/26

(52) U.S. Cl. ..... 417/222.1; 60/452

(58) Field of Search ..... 417/222.1, 270; 60/452

(56) References Cited

U.S. PATENT DOCUMENTS

| | | | | |
|---|---|---|---|---|
| 4,381,647 | A | | 5/1983 | Ruseff |
| 4,468,173 | A | | 8/1984 | Dantlgraber |
| RE31,711 | E | | 10/1984 | Horiuchi |
| 4,723,892 | A | | 2/1988 | Cowan |
| 4,934,143 | A | | 6/1990 | Ezell et al. |
| 5,032,060 | A | | 7/1991 | Kobayashi et al. |
| 5,040,367 | A | * | 8/1991 | Kauss ..... 60/452 |
| 5,197,864 | A | * | 3/1993 | Lunzman et al. ..... 417/218 |
| 5,295,796 | A | | 3/1994 | Goto et al. |
| 5,297,941 | A | | 3/1994 | Park |
| 5,515,829 | A | | 5/1996 | Wear et al. |
| 5,758,499 | A | * | 6/1998 | Sugiyama et al. ..... 60/450 |
| 5,800,130 | A | | 9/1998 | Blass et al. |
| 6,035,828 | A | | 3/2000 | Anderson et al. |

OTHER PUBLICATIONS

HPV Series Piston Pumps, Continental Hydraulics, "Axial Piston Pumps—Horsepower Limiting Control (Code 26)", 1/97, Cover, p. 1.6 and Back Cover.

RHL Hydraulics, "Axial Piston Pumps & Motors", Cover, pp. 7–8 and Back Cover. 1/97.

* cited by examiner

*Primary Examiner*—Charles G. Freay
(74) *Attorney, Agent, or Firm*—Fay, Sharpe, Fagan, Minnich & McKee, LLP

(57) ABSTRACT

A combination of a pump and a control circuit for the pump includes a variable displacement pump having a swashplate, an input line and an output line. A pressure compensator valve is in fluid communication with the output line of the variable displacement pump. A first piston has a first end operatively connected to the swashplate wherein the first piston selectively exerts a first force on the swashplate. A second piston selectively exerts a second force on the swashplate wherein the second force is in the same direction as the first force. A first biasing element is operatively associated with the second piston. The first biasing element exerts a third force on the second piston, the third force being in opposition to the second force. Preferably, a second biasing element is provided which exerts a fourth force on the swashplate wherein the fourth force is in opposition to the first force. Preferably, the first and second pistons are collinear and the first biasing element is a spring which is mounted on the second piston. The second biasing element can be a spring which is positioned on an opposite side of the swashplate from the first piston. Preferably all of the mentioned elements are located in a common housing.

28 Claims, 6 Drawing Sheets

PUMP WITH HYDRAULIC LOAD SENSOR AND CONTROLLER

BACKGROUND OF THE INVENTION

This application is a continuation-in-part of U.S. patent application Ser. No. 09/413,120 which was filed on Oct. 6, 1999 and is now abandoned. That application, in turn, is a division of U.S. patent application Ser. No. 09/005,702 which was filed on Jan. 12, 1998 and which issued as U.S. Pat. No. 5,984,646 on Nov. 16, 1999. The earlier application based its priority on provisional application, Serial No. 60/043,774 which was filed on Apr. 11, 1997.

The present invention relates to improvements in a reciprocating hydraulic motor. More specifically, the present invention relates to a hydraulic pump coupled to a hydraulic motor employing a reciprocating piston. One use for such motors is to supply slurries of paint, or other coating compositions, to the several spray heads of an airless paint sprayer system.

Hydraulic motors employing reciprocating pistons for airless paint sprayers have been used in the past. One known manufacturer of such a hydraulic motor is The Speeflo Division of Titan Tool, Inc. of Roslyn, N.Y. Other known manufacturers of hydraulic motors for airless paint sprayer systems include Graco, Inc. of Minneapolis, Minn., Durotech Co. of Moorpark, Calif. and Airlessco of Orange, Calif.

Hydraulic pumps can also be used for a variety of other purposes. For example, they can be used in connection with plastic injection molding machines, fork lifts, punch presses, log splitters, and the like. In all such uses, a hydraulically driven device, which is supplied with hydraulic fluid by a hydraulic pump, is preferably moved into position quickly but does its work at the end of the stroke: In such a device, what is required is a high volume of hydraulic fluid at a low pressure—when the device is being moved into position—and a low volume of hydraulic fluid at a high pressure—when the device does its work.

The function of the hydraulic pump needs to be regulated in all such devices in order to enable the pump to move a high volume of hydraulic fluid at a low pressure and a low volume of hydraulic fluid at a high pressure. The current control circuits for operating such pumps have not been found to be optimum. In current hydraulic pump designs for airless paint sprayers, as the pressure increases, the pump has a tendency to chatter and deliver cyclical amounts of fluid instead of a smooth, steady stream thereof. Most control circuits are also external to the housing of the pump and are thus more susceptible to leakage.

Accordingly, it is desirable to develop a new and improved hydraulic pump which would overcome the foregoing difficulties and others while providing better and more advantageous overall results.

BRIEF SUMMARY OF THE INVENTION

In one embodiment of the present invention, a control circuit for a variable displacement pump is provided.

In this embodiment of the invention, the control circuit comprises a pressure compensator valve in fluid communication with an input of an associated variable displacement pump and a first piston which selectively exerts a first force on a swashplate of the associated variable displacement pump. Also provided is a second piston which selectively exerts a second force on the first piston, and hence on the swashplate of the associated variable displacement pump wherein the second force is in opposition to the first force.

Another embodiment of the present invention relates to a combination pump and control circuit.

In accordance with this embodiment of the invention, a variable displacement pump is provided having a swashplate, an input line and an output line. A pressure compensator valve is in fluid communication with the output line of the variable displacement pump. A first piston has a first end operatively connected to the swashplate wherein the first piston selectively exerts a first force on the swashplate of the variable displacement pump. A second piston is also provided. The second piston selectively contacts the first piston and exerts a second force on a swashplate wherein the second force is in the same direction as the first force. A first biasing element exerts a third force on the swashplate, wherein the third force is in opposition to the first force. A second biasing element is operatively associated with the second piston. The second biasing element exerts a fourth force on the second piston. The fourth force is in opposition to the second force.

In accordance with still another embodiment of the present invention, a combination pump and a control circuit for the pump is provided.

More particularly, in accordance with this embodiment of the invention, the combination comprises a housing and a variable displacement pump having a swashplate, an input line and an output line wherein the variable displacement pump is positioned in the housing. A pressure compensator valve is in fluid communication with the output line of the variable displacement pump. The pressure compensator valve is positioned in the housing. A first piston has a first end operatively connected to the swashplate, wherein the first piston selectively exerts a first force on the swashplate of the variable displacement pump. The first piston is located in the housing. A second piston selectively exerts a second force on the swashplate wherein, the second force is in the same direction as the first force. The second piston is also located in the housing.

One advantage of the present invention is the provision of a new and improved hydraulic pump. The pump is particularly adapted for use with a reciprocating hydraulic motor of an airless paint sprayer system. However, the pump could also be used to power punch presses, log splitters, fork lifts, plastic injection molding machines, and the like.

Another advantage of the present invention is the provision of a hydraulic pump which is regulated by a pressure compensator valve. In this design, a piston is employed to move the swashplate of the pump. The piston is regulated by fluid pressure from the pressure compensator valve.

Still another advantage of the present invention is the provision of a hydraulic pump in which the maximum volume output is controlled by a relationship between a first piston, which adjusts the position of a swashplate of the pump, and a second piston, which adjusts the position of the first piston. By setting the ratio of these two pistons, one can control the fluid pressure at which the two pistons respectively act on the swashplate.

Yet another advantage of the present invention is the provision of a hydraulic pump employing first and second pistons to control the position of a swashplate and a spring mounted adjacent to the second piston to preset the pressure at which the second piston will begin to move in relation to the first piston, thereby controlling the pressure point at which the first piston moves the swashplate and lowers the output volume of the hydraulic pump.

Yet still another advantage of the present invention is the provision of a hydraulic pump which eliminates the hysteresis, or lag time, of the response of a first piston that controls a swashplate position of the hydraulic pump as soon as a pressure drop is detected. This feature decreases "dead band" and the response time of the hydraulic circuit.

A further advantage of the present invention is the provision of a hydraulic pump having a new and improved hydraulic feedback loop to adjust the position of a swashplate of the hydraulic pump. As pressure increases, the effect is to lower the volume demanded of the pump which makes it easier for the pump to meet the demand for hydraulic fluid. To the user, the effect is a smoother, steadier supply of the pumped product, especially at high pressures.

A still further advantage of the present invention is the provision of a hydraulic pump in which pulsations in the output of the hydraulic pump are damped.

A yet further advantage of the present invention is the provision of a hydraulic pump with a control circuit which optimizes the pressurized fluid flow output of a hydraulic pump to a given horsepower input, thus allowing a use of lower horsepower motors to power the hydraulic pump. This reduces the manufacturing cost of the system and also the amount of energy consumed.

An additional advantage of the present invention is the provision of a hydraulic pump which is more compact and lighter in weight for a given output volume of hydraulic fluid and operating pressure.

Yet another advantage of the present invention is the provision of a hydraulic pump with an internal hydraulic control circuit thereby eliminating external piping and possible hazardous leakage points due to external hydraulic connections.

Still other benefits and advantages of the present invention will become apparent to those skilled in the art upon a reading and understanding of the following detailed specification.

BRIEF DESCRIPTION OF THE DRAWINGS

The invention may take form in certain components and structures, preferred embodiments of which will be described in detail in this specification and illustrated in the accompanying drawings, wherein.

DETAILED DESCRIPTION OF THE PREFERRED EMBODIMENTS

Figure 3:
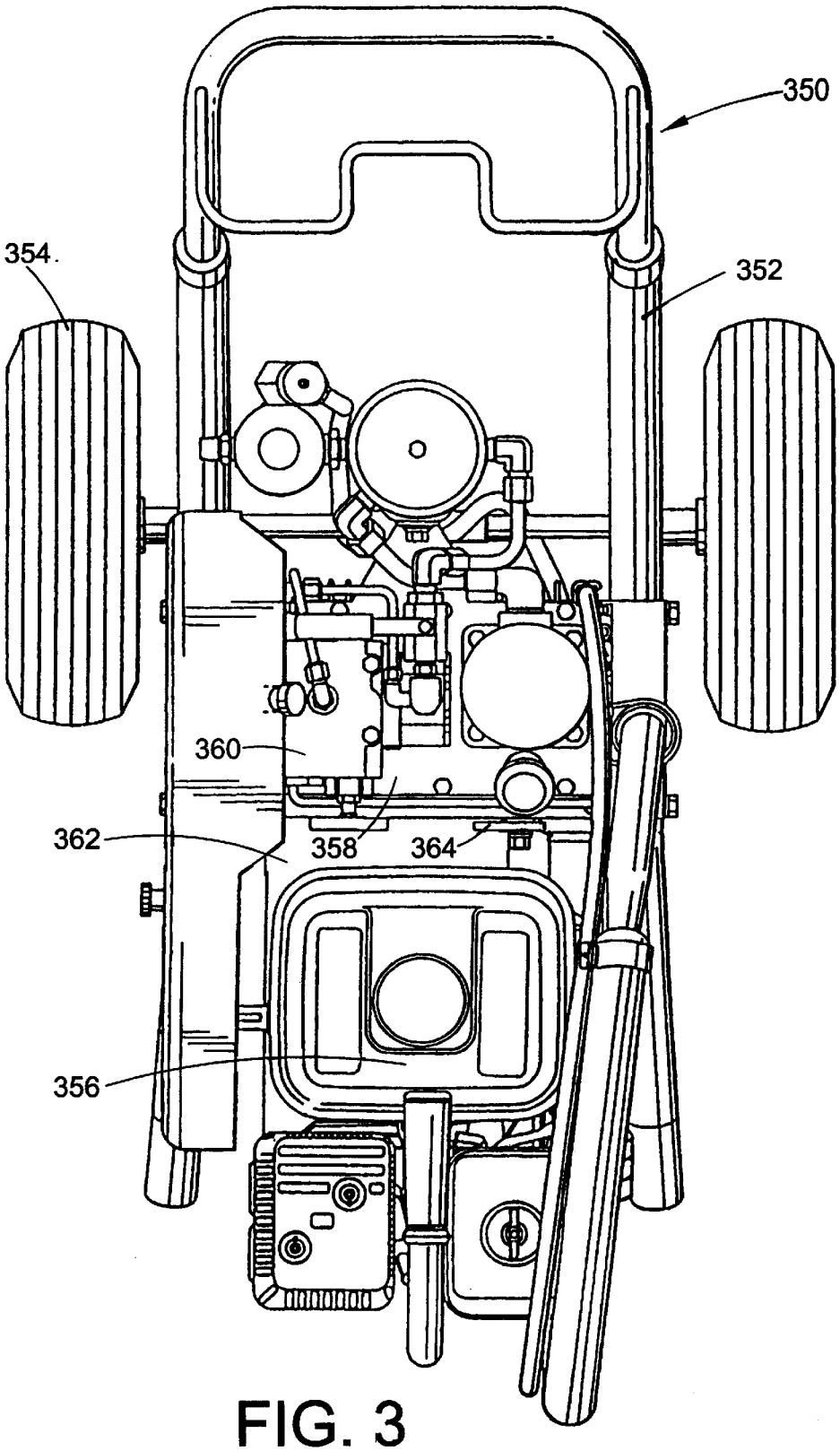
FIG. 3 is a top plan view of an airless paint sprayer using a hydraulic pump according to the present invention.

Referring now to the drawings wherein the showings are for purposes of illustrating preferred embodiments of the invention only and not for purposes of limiting same, FIG. 3 illustrates an airless paint sprayer system employing a hydraulic pump having a hydraulic load sensor and controller according to the present invention.

A conventional hydraulic pump employed with the hydraulic motor of the present invention is a variable displacement pump which has a set of cylinders arrayed in a circular pattern for pressurizing the hydraulic fluid. The cylinder's stroke is determined by the position of a swashplate which the cylinders act against. The pump has an external adjustment for setting the pump maximum operating pressure by setting the compression of a relief spring. When the pump's pressure reaches its maximum setting, the internal relief valve opens and moves the swashplate to a neutral position. Pressure therefore ceases to build. When pressure drops, the valve closes and the swashplate moves out of the neutral position. At this time, the cylinders begin building pressure again.

This type of hydraulic pump is conventionally used with hydraulic motors of airless spray paint equipment. A significant performance problem exists with such conventional hydraulic pumps. Since the volume of hydraulic fluid needed by the paint pump actually decreases above a certain pressure, the pump supplies hydraulic fluid at a volume greater than what is otherwise necessary above such pressure. With the swashplate set at its default maximum displacement, and therefore maximum hydraulic flow, until the maximum pressure is reached, the demand on the power supply (work=P×V) rises with pressure faster than otherwise required. To take a specific example, when the tip of a spray nozzle has an opening of 0.041 inches, paint at 2 gal/min. can be sprayed at 1900 psi. However, when the diameter of the opening is at 0.009 inches, at a pressure of 3000 psi, only ⅜th of a gallon of paint is sprayed per minute. But the conventional hydraulic pump continues to pump a larger than necessary volume of paint at this greater pressure.

Figure 1:
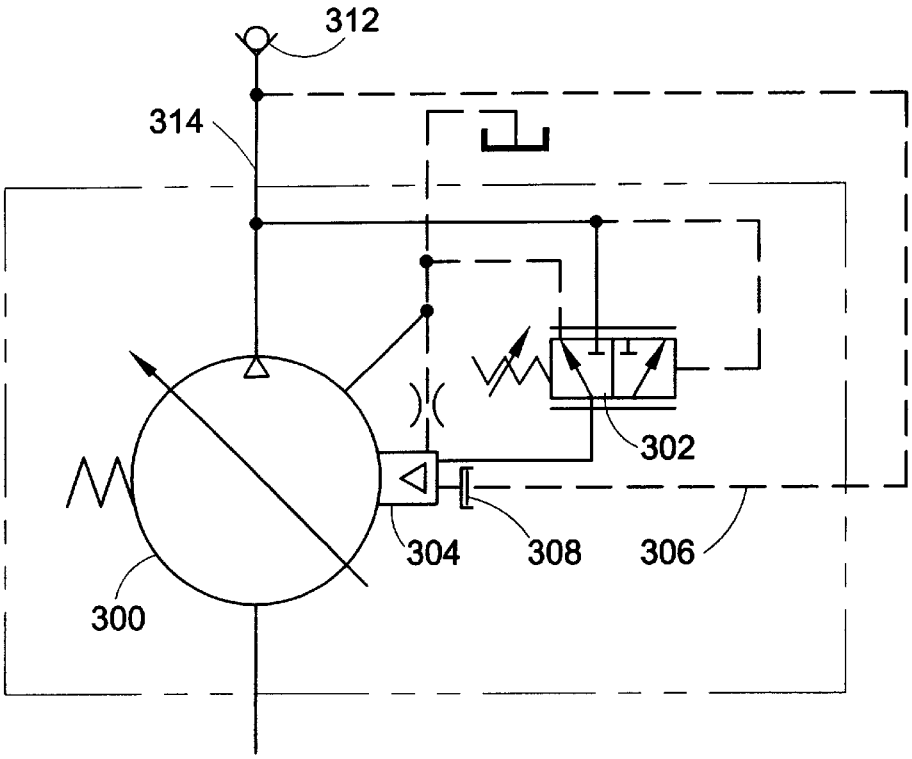
FIG. 1 is a hydraulic circuit diagram of a pump according to a first embodiment of the present invention.

With reference now to FIG. 1, a variable displacement pump 300 according to the present invention, is controlled by a pressure compensator valve 302. The pressure compensator valve 302 uses fluid pressure to move the swashplate of the pump 300 via a first piston 304 which is connected to the swashplate. When the pressure drops, the control valve closes and a spring (not illustrated) behind the first piston returns it to a fully open position. Also provided in the present invention is an outlet line 306 from the hydraulic pump. The output pressure of the hydraulic pump is used to drive a second piston 308 which adjusts the position of the swashplate of the pump 300. More (specifically, the second piston 308 acts on the first piston 304 and in opposition to the action of the first piston. As pressure increases, the effect is to lower the volume demanded of the pump by the action of the first piston 304, which makes it easier for the power supply to meet demand. In other words, a parallel external control circuit is provided.

With the invention illustrated in FIG. 1, the diameter of the second piston 308 is smaller than is the diameter of the first piston 304. By sizing the diameter of the second piston 308, one can set the pressure at which the first piston 304 begins to move (i.e. the pressure at which that first piston's spring preload is overcome by the force exerted by the second piston). In the present invention, the second piston's diameter is sized so that the first piston 304 and the swashplate, begin to move at about 2500 psi. Below this pressure, the pump's volume output is at a maximum. This design is advantageous over a known horsepower limiter design because it does not have the higher leakage, higher temperatures and, likely, higher costs that a horsepower limiter design would have.

Also provided is a check valve 312 downstream from the pump. The check valve is located in a hydraulic supply line 314 between the output and the hydraulic oil motor. The purpose for the check valve is to reduce detrimental feedback to the pump from the oil motor allowing the pump to run more smoothly and reducing output pressure swings in the oil motor. Such output pressure swings are known as "dead band" and can cause paint spray patterns to pulsate or "wink." Check valve 312 also improves the pressure characteristics of the pump allowing the pump to be operative at paint pressures of 300 to 400 psig. This is in comparison to the conventional pumps which are only operative down to about 450 psig.

Figure 2:
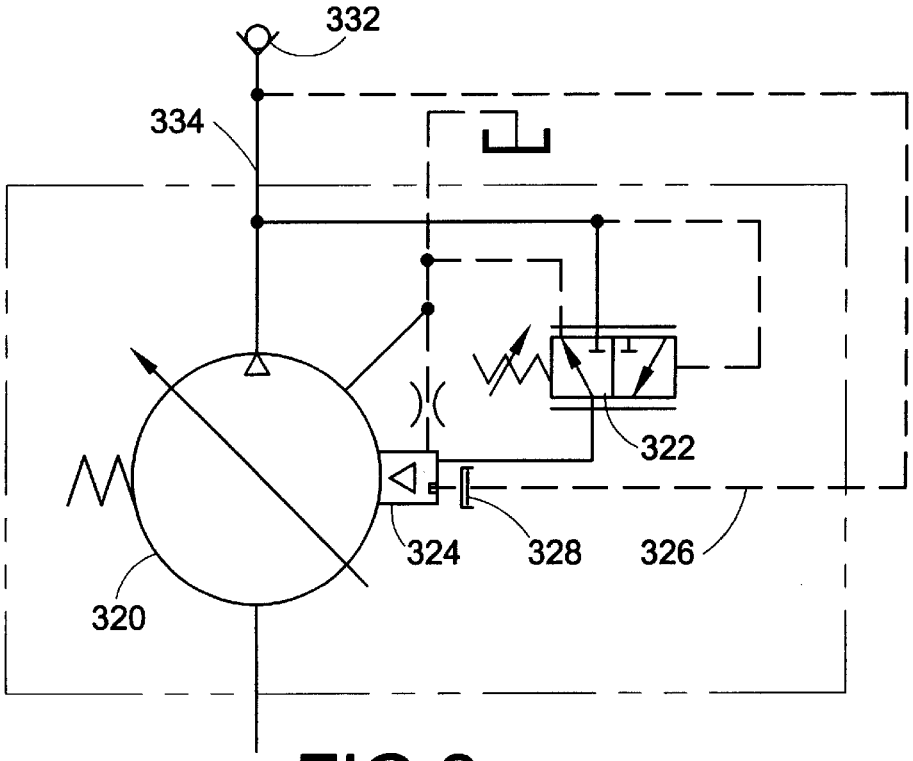
FIG. 2 is a hydraulic circuit diagram of a pump according to a second embodiment of the present invention.

With reference now to FIG. 2, another version of a pump control system is there illustrated. In this embodiment, a pump 320 is regulated by a pressure compensator valve 322. The pressure compensator valve 322 uses fluid pressure to move the swashplate of the pump 320 via a first piston 324 which is connected to the swashplate. An external line 326 is provided from the hydraulic pump output. The output pressure of the hydraulic pump is used to drive a second piston 328 which adjusts the position of the swashplate of the pump 320. Also provided is a check valve 332 located in an output line 334 of the assembly. In this embodiment, a slightly longer piston 328 is provided than the second piston 308 in FIG. 12. The increased length of the second piston 328 prevents the first piston 324, which is connected via a hydraulic line to the pressure compensator valve 322, from moving to a fully open position. This lowers the flow of fluid through the pump 320 and has a horsepower limiting effect. The version illustrated in FIG. 2 allows the use of a lower horsepower gas engine to power the pump 320 for a hydraulic motor at the pressures required in an airless paint sprayer system. Normally, such a smaller engine would tend to stall, were it not for the volume limiting feature of the hydraulic circuit illustrated in FIG. 2.

To the user, the effect of the hydraulic circuits illustrated in FIGS. 1 and 2 is a smoother, steadier supply of paint, especially at high pressure. Such circuits are known as volume limiters. Applicant has found that these hydraulic circuits and pump designs provide a noticeable performance difference in relationship to the known hydraulic pumps.

Figure 4:
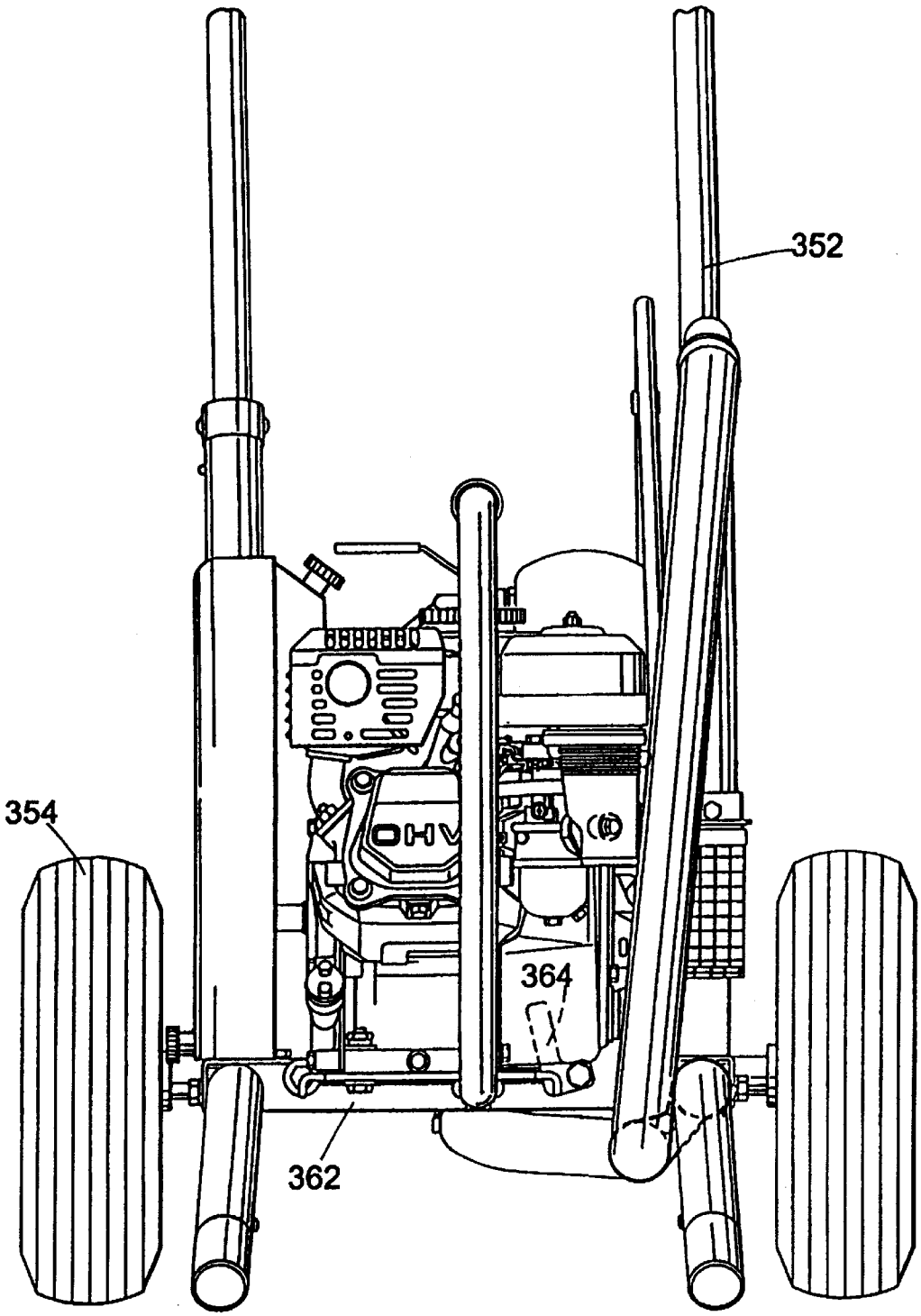
FIG. 4 is a front elevational view of the airless paint sprayer of FIG. 3.

With reference now to FIGS. 3 and 4, they illustrate an airless paint sprayer system according to the present invention and generally designated by the numeral 350. The paint sprayer system includes a frame 352 mounted on wheels 354. Mounted on the frame 352 is an engine generally designated as 356 which serves to move hydraulic fluid from a hydraulic fluid tank 358 to a hydraulic motor 360. The motor itself is mounted via a motor mount plate 362. A latch 364 is employed to selectively secure the motor in place. The latch which retains the motor plate 362 in its mating slot requires no tools so that users can easily change to a different type of motor. With this type of motor mount arrangement, the motor will not vibrate loose on the frame 352.

Figure 5:
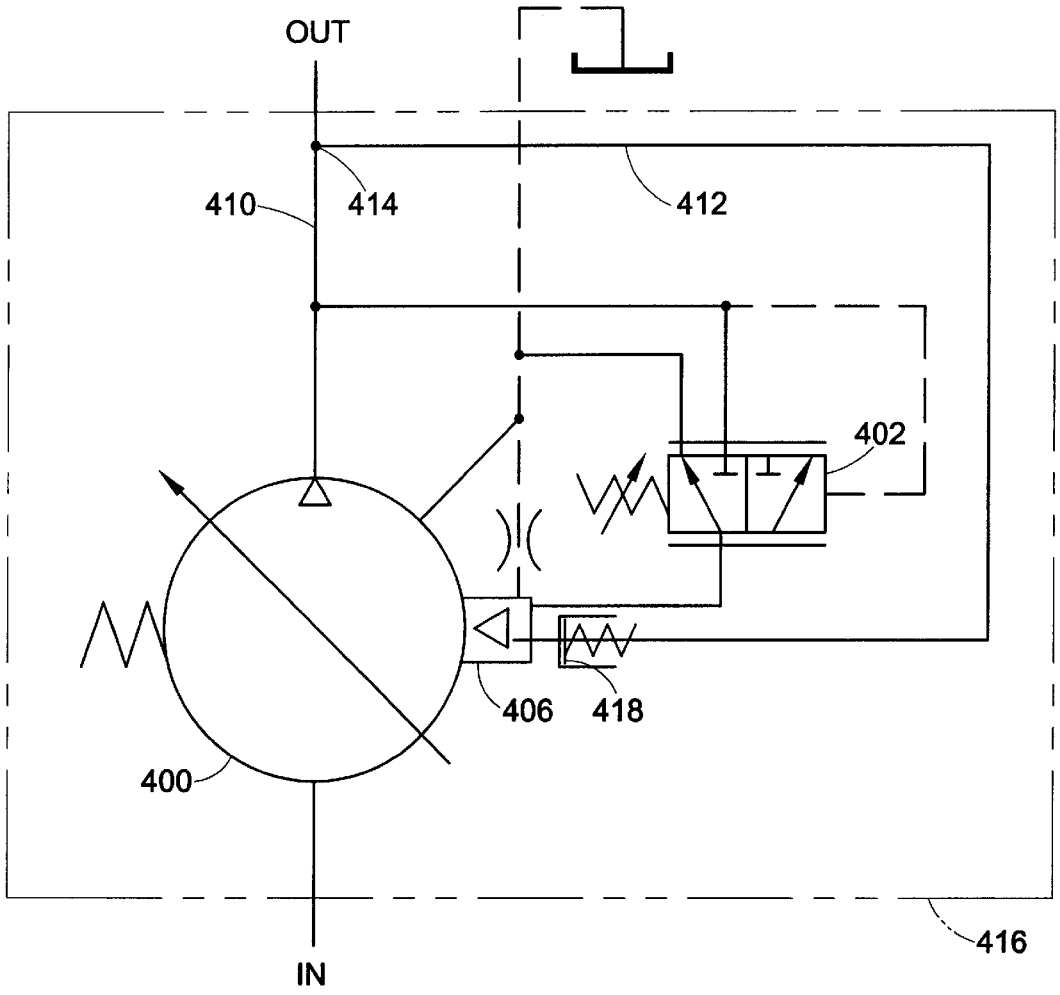
FIG. 5 is a hydraulic circuit diagram of a pump according to a third embodiment of the present invention.
Figure 7:
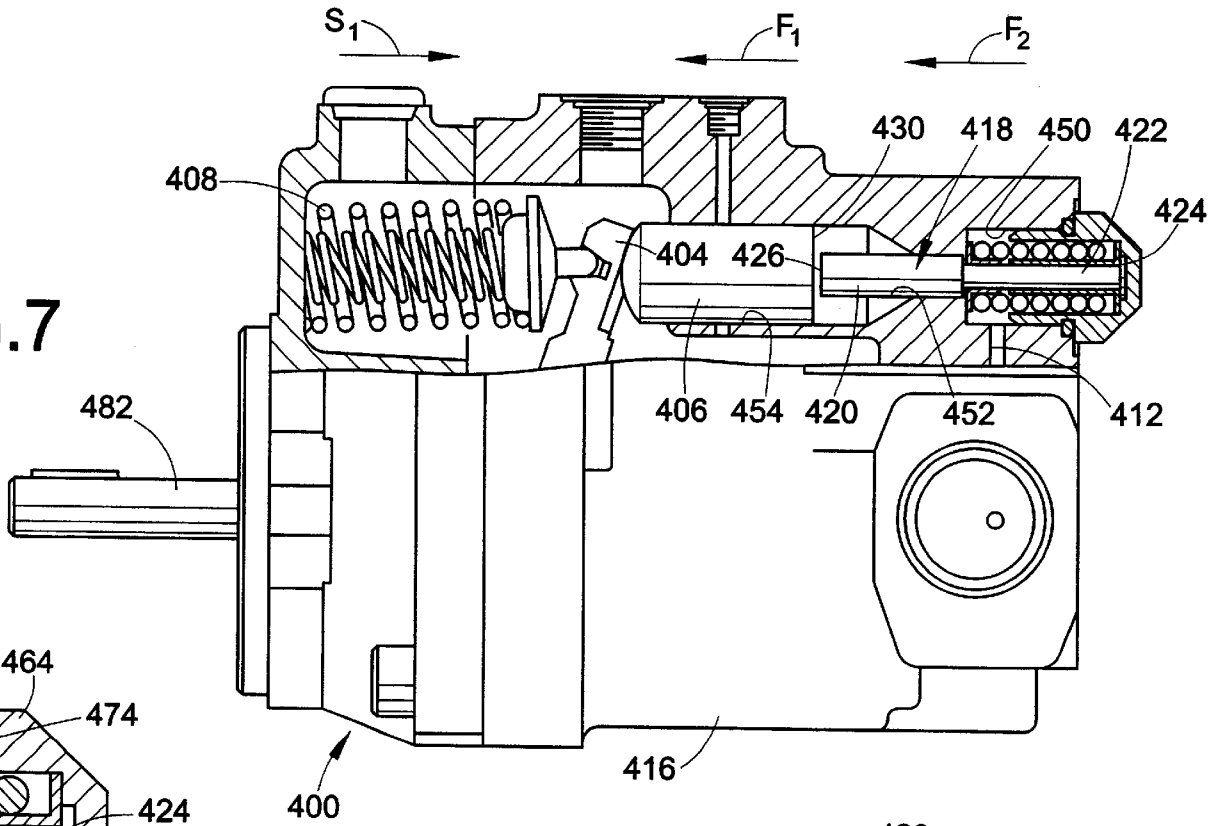
FIG. 7 is an assembled side elevational view, partially in cross-section, of the pump of FIG. 6.

With reference now to FIG. 5, a variable displacement pump 400 according to a third embodiment of the present invention is there illustrated. The pump is controlled by a pressure compensator valve 402. With reference now also to FIG. 7, the pressure compensator valve uses fluid pressure to move a swashplate 404 of the pump via a swashplate control piston or first piston 406 which is operatively connected to the swashplate. When the pressure drops, the control valve closes and at least one first spring 408 (two nested springs are shown), located on an opposite side of the swashplate from the first piston 406, returns the swashplate to a fully open position. The first piston 406 exerts a first force $F_1$ on the swashplate 404. The force $F_1$ is in opposition to a force S, exerted on the swashplate by the first spring 408.

Also provided in the present invention is an outlet line 410 from the hydraulic pump. The outlet line 410 communicates with a return line 412 via a port 414. In contrast to the embodiments illustrated in FIGS. 1 and 2, the return line 412 is internal to a housing 416 of the pump. Since the control circuit is internal within the housing 416, a very compact design is achieved. The output pressure of the hydraulic pump is used to drive a second piston 418, sometimes referred to as a pin (because it has a smaller diameter than the first piston 406), which adjusts the position of the swashplate of the pump 400. More specifically, the second piston 418 acts on the first piston 406 and exerts a second force $F_2$ on the first piston, and hence on the swashplate, in the same direction as the first force $F_1$. As pressure increases, the effect is to lower the volume demanded by the pump 400 by the action of the first piston 406 which makes it easier for the power supply to meet demand. In other words, a parallel internal control circuit is provided.

It is evident from FIG. 7 that the diameter of the second piston 418 is smaller than the diameter of the first piston 406. More particularly, in one preferred embodiment, the approximate piston area ratio of first piston to the second piston is 4.464 to 1. By sizing the diameter of the second piston 418, one can set the pressure at which the first piston 406 begins to move (i.e. the pressure at which the first piston's spring preload—set by spring 408—is overcome by the force $F_2$ exerted by the second piston). The length of the second piston, or control span, controls the maximum volume output of the hydraulic pump by controlling the maximum angle of deflection of the swashplate 404. Preferably, the diameter of the control pin, or second piston 418 is constant for various models of pump thereby eliminating the need for separate control pin housing adapters.

Figure 6:
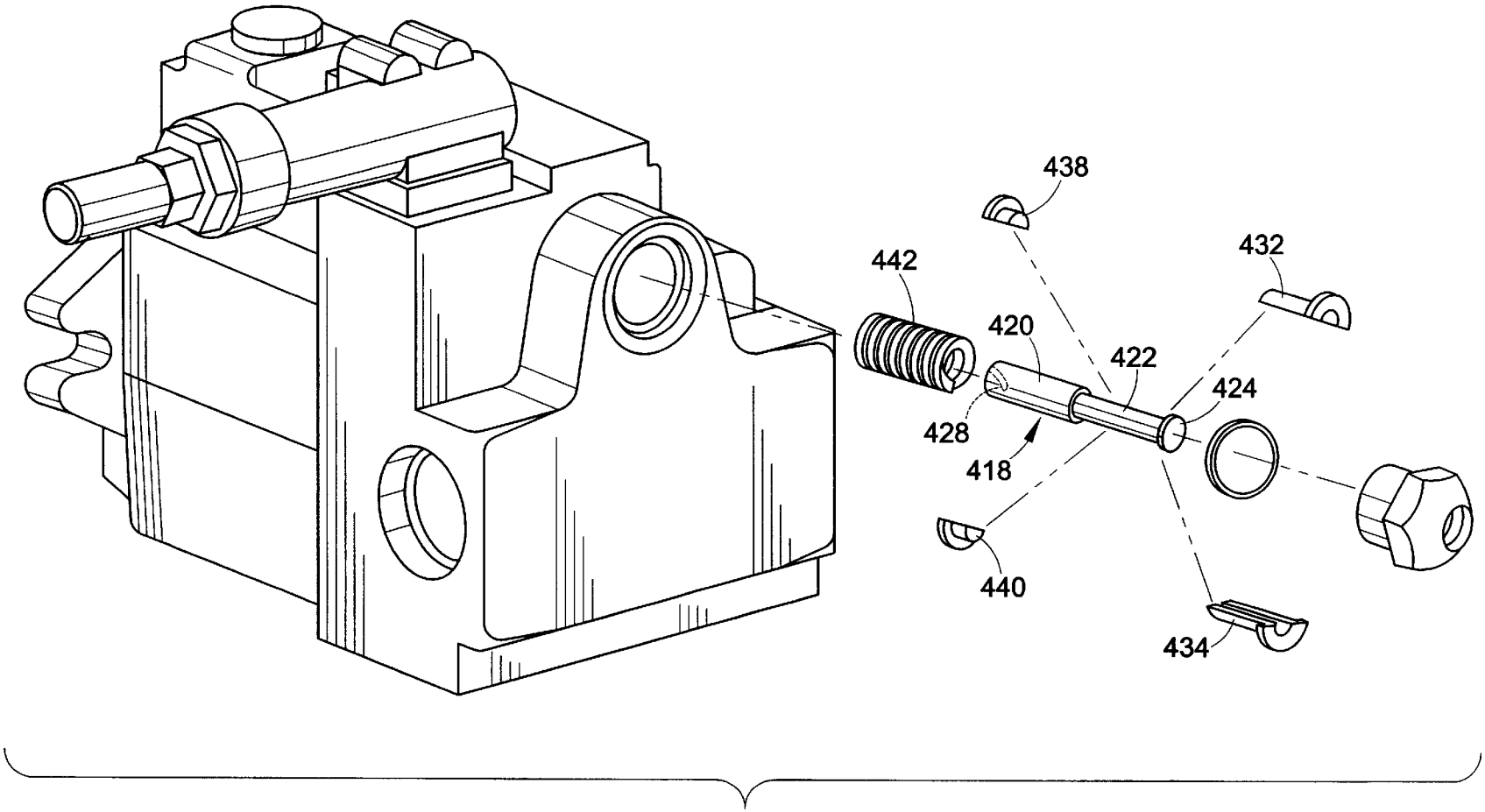
FIG. 6 is an exploded perspective view of the hydraulic pump according to the third embodiment of the present invention.
Figure 9:
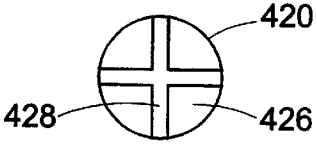

With reference now also to FIG. 6, the second piston 418 comprises a head 420 of a first diameter and a stem 422 of a second, and smaller, diameter. Provided on a distal end of the second section is a tip 424 of a third diameter. As may be best seen from FIG. 8, the tip 424 can have the same diameter as the diameter of the head 420. A distal end 426 of the piston head 420 is provided with at least one groove 428. In the embodiment illustrated in FIG. 9, a cruciform shaped groove is shown. As best shown in FIG. 7, the purpose for the groove is to allow hydraulic fluid to flow away from a contact area between the distal end 426 of the head 420 of the second piston 418 and a proximal end 430 of the first piston 406. A groove or a relief area of any particular design would suffice. The groove 428 at the distal end 426 of the second piston 418 provides hydraulic pressure and volume to actuate the second piston assembly 418 thus eliminating the need for external pressure lines and fittings that are delicate and prone to leakage and which could be hazardous to the environment and costly to clean up.

With reference again to FIG. 6, positioned on the second piston stem 422 are a split guide first half 432 and a split guide second half 434. Also positioned on the stem 422 are a split stop first half 438 and a split stop second half 440. Held between the split guide halves 432 and 434 and split stop halves 438 and 440 is a second spring 442.

With reference again to FIG. 7, extending inwardly from one face of the housing 416 of the pump 400 is a first bore 450. The first-bore communicates with and is co-axial with a second bore 452 which is of a smaller diameter than is the first bore. The second bore 452, in turn, communicates with and is co-axial with a third bore 454 having a larger diameter than both the second bore 452 and the first bore 450. Positioned in the third bore 454 is the first piston 406. Slidably mounted in the second bore 452 is the second piston 418. More specifically, the head 420 of the second piston 418 is positioned in the second bore 452 whereas the stem 422 of the second piston 418 is positioned in the first bore 450.

Figure 8:
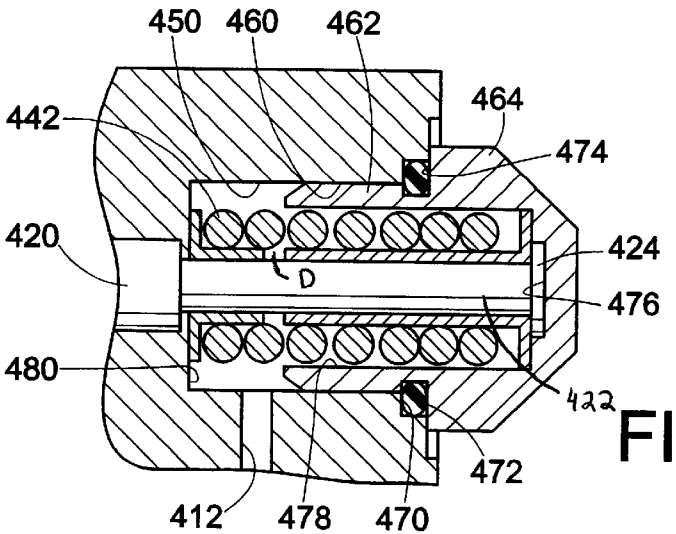
FIG. 8 is an enlarged cross-sectional view of a portion of the pump of FIG. 7; and, FIG. 9 is an enlarged end elevational view of a second piston of the hydraulic pump of FIG. 6.

With reference now to FIG. 8, the first bore 450 has a threaded portion 460 for cooperating with the threaded end 462 of a plug 464 in order to secure the second piston in place in the housing 416. In order to ensure that no hydraulic fluid leaks out around the plug 464, a recessed section 470 of the first bore 450 accommodates and o-ring 472 which abuts against a shoulder 474 of the plug 464.

It is evident that the compression of the second spring 442 is controlled by the threading of the plug 464 into the first bore 450. As can be seen best in FIG. 8, the plug has an internal bore 476 of a first diameter which accommodates the tip 424 of the second piston 418 pushing the second piston further into the third bore 454. An internal bore 478 of a second diameter in the plug accommodates the split guide halves 432, 434 and the second spring 442. The split stops 438 and 440 are thus pushed away from the head 420 of the second piston, by contacting a shoulder 478 in the housing 416 thereby compressing the spring 442. The size of the spring 442 will determine the amount of control that the second piston 418 will exert on the first piston 406. The length of the second piston will control the maximum volume of the pump 400.

The second spring 442 is captured between the split guide halves 432, 434 and the split stop halves 438, 440, on the stem 422 of the second piston 418, sometimes termed a pin. The captured spring 442 provides four separate functions. First, the spring rate of the spring 442 determines the pressure point at which destroking of the swashplate 404 will occur. Thus, one can size the spring rate at which the second piston 418 will begin to move against the swashplate control piston (first piston) 406. Second, the spring 442 provides an instant return of the second piston 418 to its maximum volume set point. This eliminates a possible jamming of the second piston 418 against the first piston 406.

Third, the spring 442 eliminated hysteresis of the swashplate control piston (first piston) 406 by unloading the force of the second piston 418 against the first piston thus allowing the swashplate 404 to move to its maximum volume set point. This reduces the response time of the control circuit hence decreasing dead band pressure drop in, e.g., a spray gun of an airless spray system. Fourth, the spring 442, in conjunction with the second piston 418 acts as a pulsation dampener (which absorbs the pressure spikes when a spool valve is opened and closed in a reciprocating hydraulic paint pump) in the pressure control circuit. This eliminates the need for a check valve (such as the check valves 312 of FIG. 1 and 332 of FIG. 2) located between the hydraulic pump and the reciprocating hydraulic motor of the paint pump. Furthermore, this design reduces the heat rise, which is caused by the restricting effect of the check valve ball, thus reducing the overall operating temperature of the system.

The split guide halves 432, 434 and split stop halves 438, 440 act as a spring retainer. The spring retainer performs four functions. First, it prevents the second spring 442 from being over-compressed, which would cause premature failure of the spring. With reference again to FIG. 8, it is evident that the spring 442 cannot be compressed more than the distance D between proximal ends of the pairs of split guides and split stops. Second, the spring retainer limits the stroke length of the second piston 418 thus preventing over-travel of the swashplate 404 at high pressure. Third, the pair of guides 432, 434 and pair of stops 438, 440 retain the spring 442 on the stem 422 of the second piston 418 without additional hardware. Fourth, the spring retainer serves as a guide to center the stem 422 of the second piston 418 inside the spring to distribute loading equally.

In this embodiment, the variable displacement pump 400 is regulated by the pressure compensator valve 402. The pressure compensator valve uses hydraulic fluid pressure to move the swashplate 404 of the pump via the first piston 406. The internal pressure port 414 communicates with the hydraulic pump output line 410. The output pressure of the hydraulic pump is thus used to drive the second piston 418, via return line 412, which adjusts the position of the swashplate 404. By sizing the length of the second piston 418, the maximum volume output of the hydraulic pump 400 can be controlled. By sizing the diameter of the second piston 418 to a diameter which is smaller than the diameter of the first piston 406, one can set the pressure at which the first piston 406 begins to move against the second piston and overcome the spring preload of the second piston.

By sizing the spring rate of the captured spring 442, one can preset the pressure at which the second piston 418 will move against the first piston 406. Therefore, one can control the pressure point at which the first piston 406 moves the swashplate 404 and lowers the output volume of the hydraulic pump 400. The captured spring 442 eliminates the hysteresis, or lag time, in the response of the first piston 406 that controls swashplate position. As soon as a pressure drop is detected, the force of the second spring 442 moves the second piston 418 away from the first piston 406 allowing the pressure compensator to act directly to unload the force against the first-piston 406. This feature decreases dead band and response time of the pressure compensator of the hydraulic circuit. Furthermore, the accumulator effect, or pulsation dampening, created by the captured spring 442 on the second piston 418 eliminates the need for a check valve in the output line. The simplicity of the instant hydraulic circuit lowers manufacturing cost due to the internal hydraulic passages (412, 414) which are provided.

With a design according to the present invention, a significantly smaller conventional motor (not illustrated) can be provided for rotating an input shaft 482 (FIG. 7) of the pump 400. Nevertheless, the pump 400 will be able to pump the same amount of a fluid, such as paint, as known pumps. More particularly, a known hydraulic pump for airless paint sprayers is a 16-horsepower machine which weights 485 lbs. and pumps 3 gallons of paint per minute. In contrast, a pump according to the present invention is an 8-horsepower pump weighing 189 lbs. which will pump 3½ gallons of paint per minute. In addition, the pump of the present invention also saves a significant amount of fuel.

This version of the hydraulic circuit optimizes the pressurized fluid flow output of the hydraulic pump sized to a given horsepower input thus allowing the use of lower horsepower gas engines or electric motors to power the hydraulic pump 400. This reduces the manufacturing cost of an airless paint spray system and also reduces the amount of energy being consumed by the user to power the pump. Furthermore, airless paint spray systems with this technology are more compact and lighter in weight for a given paint output and operating pressure.

The invention has been described with reference to several preferred embodiments. Obviously, modifications and alterations will occur to others upon a reading and understanding of this specification. It is intended to include all such modifications and alterations insofar as they come within the scope of the appended claims or the equivalents thereof.

What is claimed is:

1. A control circuit for a variable displacement pump, comprising:

a pressure compensator valve in fluid communication with an associated variable displacement pump;

a first piston which selectively exerts a first force on a swashplate of the associated variable displacement pump;

a second piston which selectively exerts a second force on said first piston, and hence the swashplate of the associated variable displacement pump, wherein said second force is in the same direction as said first force;

a first biasing element which exerts a third force on the swashplate of the associated variable displacement pump, wherein said third force is in opposition to said first force; and, a second biasing element which exerts a fourth force on said second piston.

2. The control circuit of claim 1 wherein said second piston has a diameter which is smaller than a diameter of said first piston.

3. The control circuit of claim 1 wherein said first piston is positioned adjacent one side of the swashplate of the associated variable displacement pump.

4. The control circuit of claim 1 wherein said second piston is of sufficient size to prevent said first piston from fully opening the swashplate of the associated variable displacement pump.

5. The control circuit of claim 1 wherein said fourth force is in opposition to said second force.

6. The control circuit of claim 1 wherein said second piston comprises:

a head of a first diameter; and a stem of a second, and smaller, diameter.

7. A combination pump and control circuit therefor, comprising:

a variable displacement pump having a swashplate, an input line and an output line;

a pressure compensator valve in fluid communication with said output line of said variable displacement pump;

a first piston having a first end operatively connected to said swashplate, wherein said first piston selectively exerts a first force on said swashplate;

a second piston which selectively contacts said first piston and exerts a second force on said swashplate, wherein said second force is in the same direction as said first force;

a first biasing element which exerts a third force on said swashplate wherein said third force is in opposition to said first force; and, a second biasing element operatively associated with said second piston, wherein said second biasing element exerts a fourth force on said second piston, said fourth force being in opposition to said second force.

8. The combination of claim 7 wherein said second piston has a diameter which is smaller than a diameter of said first piston.

9. The combination of claim 7 wherein said second piston comprises a head of a first diameter and a stem of a second, and smaller, diameter.

10. The combination of claim 9 further comprising a groove located on an end face of said second piston head, said second piston end face, selectively contacting said first piston.

11. The combination of claim 9 further comprising a guide member positioned on said stem, and wherein said second biasing element is a spring which coils around said guide member.

12. The combination of claim 11 wherein said guide member comprises a first portion and a second portion, said first and second portions of said guide member substantially encircling said stem of said second piston.

13. A combination pump and control circuit for the pump, comprising;

a housing;

a variable displacement pump having a swashplate, an input line and an output line, said variable displacement pump being positioned in said housing;

a pressure compensator valve in fluid communication with said output line of said variable displacement pump, said pressure compensator valve being positioned in said housing;

a first piston having a first end operatively connected to said swashplate, wherein said first piston selectively exerts a first force on said swashplate of the variable displacement pump, said first piston being located in said housing;

a second piston which selectively exerts a second force on said swashplate, wherein said second force is in the same direction as said first force, said second piston being located in said housing; and, wherein said second piston comprises a head and a stem, said second piston stem being of a smaller diameter than said second piston head, and wherein said second piston head has a diameter which is smaller than a diameter of said first piston.

14. The combination of claim 13 further comprising:

a guide member comprising:

a first half, and a second half, wherein said guide member halves are positioned around said stem of said second piston; and a stop member comprising:

a first half, and a second half, wherein said stop member halves are positioned around said stem of said second piston in spaced relation to said guide member halves.

15. The combination of claim 14 further comprising a spring located on said stem of said second piston and held between said guide member and said stop member.

16. The combination of claim 13 further comprising:

a bore in said housing, wherein said second piston is located in said bore; and, a plug for selectively sealing said bore.

17. The combination of claim 16 further comprising a return line located in said housing and communicating said output line with said bore.

18. A control circuit for a variable displacement pump comprising:

a first piston which selectively exerts a first force on a swashplate of an associated variable displacement pump;

a second piston which selectively exerts a second force on said first piston and hence the swashplate of the associated variable displacement pump wherein the second force is in the same direction as said first force;

a first biasing element which exerts a third force on the swashplate of the associated variable displacement pump, said third force being in opposition to said first force; and, a second biasing element operatively connected to said second piston, wherein said second biasing element exerts a fourth force on said second piston, said fourth force being in opposition to said second force.

19. The control circuit of claim 18, further comprising:

a guide member mounted on said second piston; and a stop member mounted on said second piston in spaced relation to said guide member wherein said biasing element is located between said guide member and said stop member.

20. The control circuit of claim 19, wherein said guide member comprises:

a first half; and a second half wherein said guide member halves are positioned around a stem of said second piston.

21. The control circuit of claim 20, wherein said stop member comprises:

a first half; and a second half wherein said stop member halves are positioned around said stem of said second piston in spaced relation to said guide member halves.

22. A control circuit for a variable displacement pump comprising:

a first piston which selectively exerts a first force on a swashplate of an associated variable displacement pump;

a second piston which selectively exerts a second force on said first piston and hence the swashplate of the associated variable displacement pump wherein the second force is in the same direction as said first force; and, a biasing element operatively associated with said second piston, wherein said biasing element exerts a third force on said second piston, said third force being in opposition to said second force; and, wherein said second piston comprises:

a piston head;

a stem extending from one end of said piston head and being co-axial therewith; and, a tip mounted on a distal end of said stem, wherein said tip has a larger diameter than a diameter of said stem.

23. The control circuit of claim 22, further comprising:

a guide member mounted on said piston stem; and a stop member mounted on said piston stem in spaced relation to said guide member wherein said biasing element is positioned between said guide member and said stop member in order to urge one of said guide member and said stop member towards said piston head and another of said guide member and said stop member towards said piston tip.

24. A control circuit for a variable displacement pump comprising:

a first piston which selectively exerts a first force on a swashplate of an associated variable displacement pump;

a second piston which selectively exerts a second force on said first piston and hence the swashplate of the associated variable displacement pump wherein the second force is in the same direction as said first force; and, a biasing element operatively associated with said second piston, wherein said biasing element exerts a third force on said second piston, said third force being in opposition to said second force; and, wherein said second piston comprises a proximal end positioned adjacent a distal end of said first piston and a groove formed in said second piston proximal end.

25. The control circuit of claim 24 wherein said biasing element comprises a spring mounted on said second piston.

26. A control circuit for a variable displacement pump comprising:

a first piston which selectively exerts a first force on a swashplate of an associated variable displacement pump;

a second piston which selectively exerts a second force on said first piston and hence the swashplate of the associated variable displacement pump; and a spring mounted on said second piston, said spring exerting a third force on said second piston, said third force being in opposition to said second force.

27. The control circuit of claim 26 wherein said second piston comprises a stem and a head located on one end of said stem, said spring being mounted on said stem.

28. The control circuit of claim 27 further comprising a tip mounted on a distal end of said stem, said tip having a larger diameter than a diameter of said stem.

* * * * *